US010682741B2

(12) United States Patent
Boiteux

(10) Patent No.: US 10,682,741 B2
(45) Date of Patent: Jun. 16, 2020

(54) DEVICE FOR CLAMPING A WORKPIECE ON A TOOL

(71) Applicant: Christophe Boiteux, Landresse (FR)

(72) Inventor: Christophe Boiteux, Landresse (FR)

( * ) Notice: Subject to any disclaimer, the term of this patent is extended or adjusted under 35 U.S.C. 154(b) by 0 days.

(21) Appl. No.: 14/391,421

(22) PCT Filed: Apr. 5, 2013

(86) PCT No.: PCT/FR2013/050754
§ 371 (c)(1),
(2) Date: Oct. 9, 2014

(87) PCT Pub. No.: WO2013/153319
PCT Pub. Date: Oct. 17, 2013

(65) Prior Publication Data

US 2015/0069689 A1 Mar. 12, 2015

(30) Foreign Application Priority Data

Apr. 12, 2012 (FR) ..... 12 53377

(51) Int. Cl.
*B25B 5/06* (2006.01)
*B25B 5/08* (2006.01)

(52) U.S. Cl.
CPC ..... *B25B 5/064* (2013.01); *B25B 5/087* (2013.01); *Y10T 29/494* (2015.01)

(58) Field of Classification Search
CPC ..... B25B 5/064; B25B 5/087; Y10T 29/494
See application file for complete search history.

(56) References Cited

U.S. PATENT DOCUMENTS 4,620,695 A * 11/1986 Vanistendael ..... B25B 5/16 269/24
5,118,088 A * 6/1992 Sawdon ..... B25B 5/122 269/27

(Continued)

FOREIGN PATENT DOCUMENTS

FR 2 863 190 6/2005
JP 2004-268186 A 9/2004

(Continued)

OTHER PUBLICATIONS

PCT/FR2013/050754 International Search Report dated Aug. 7, 2013 (4 pages including English translation).

(Continued)

*Primary Examiner* — David P Bryant
*Assistant Examiner* — Nirvana Deonauth
(74) *Attorney, Agent, or Firm* — Brinks Gilson & Lione; John C. Freeman

(57) ABSTRACT

A device for clamping a workpiece on tool includes a ram and a clamp, the ram being selectively actuated by a pressurized fluid. The ram includes a body which, when in use, is secured to the tool and a slide mounted such that it can slide with respect to the body. The clamp is hinged with the slide about a pivot axis. The body includes a front face beyond which the clamp projects when it is in a clamping position in order to clamp the workpiece. In addition, the clamp has a release position which it reaches at least partially by pivoting about the pivot axis. The slide includes a piston and a rod that are assembled to one another. The pivot axis is offset by a predetermined distance with respect to the axis of the rod in the direction of the front face.

9 Claims, 6 Drawing Sheets

(56) References Cited

U.S. PATENT DOCUMENTS

| | | | | |
|---|---|---|---|---|
| 6,059,277 | A | 5/2000 | Sawdon et al. | |
| 6,199,847 | B1 * | 3/2001 | Fukui | B25B 5/122 269/32 |
| 6,612,557 | B2 * | 9/2003 | Sawdon | B25B 5/122 269/228 |
| 6,908,077 | B2 * | 6/2005 | Sawdon | B25B 5/064 269/32 |
| 2004/0061268 | A1 | 4/2004 | Sawdon | |
| 2005/0225018 | A1 * | 10/2005 | Tunkers | B25B 5/12 269/243 |
| 2005/0275147 | A1 * | 12/2005 | Steele | F15B 15/063 269/32 |
| 2006/0290042 | A1 * | 12/2006 | Colby | B25B 5/061 269/32 |
| 2008/0179804 | A1 * | 7/2008 | McIntosh | B25B 5/122 269/32 |
| 2008/0230973 | A1 * | 9/2008 | Miyazaki | B23Q 3/082 269/309 |
| 2009/0108513 | A1 * | 4/2009 | Hara | B25B 5/087 269/89 |
| 2010/0066002 | A1 * | 3/2010 | Yokota | B23Q 3/06 269/257 |

FOREIGN PATENT DOCUMENTS

| | | | |
|---|---|---|---|
| JP | 2009-006404 | A | 1/2009 |
| JP | 2009-072891 | A | 4/2009 |
| WO | WO 2005/056241 | A1 | 6/2005 |

OTHER PUBLICATIONS

Office Action, and English language translation thereof, in corresponding Japanese Application No. 2015-505000, dated Dec. 20, 2016, 9 pages.

* cited by examiner

DEVICE FOR CLAMPING A WORKPIECE ON A TOOL

This application claims priority to International Application No. PCT/FR2013/050754 filed Apr. 5, 2013 and French Patent Appln. 1253377 filed Apr. 12, 2012; the entire contents of each are incorporated herein by reference.

BACKGROUND

The invention relates to a clamping device of a workpiece on a tool, of the type comprising a flange actuated by a cylinder, which retracts and which moves linearly in the clamping phase.

Such a clamping device is known from document FR 2 863 190, a patent application filed by the present inventor. This device comprises a body comprising a lower part of cylindrical form and an upper part in the form of a clevis. A flange is mounted mobile between the two wings of the clevis and is actuated by the rod of a cylinder housed in the lower part. The flange moves between a gripping position and a release position. Movement from the gripping position to the release position comprises a first translation phase parallel to the axis of the cylinder followed by a rotation phase to give access to the tool to remove the workpiece and place another. Movement from the release position to the gripping position follows the same trajectory, in the reverse direction of the preceding.

In the positions of the translation phase, the flange is guided by support elements made by heels of the flange and support surfaces of the wings of the clevis. It is also guided by a pivot at the end of the rod. The geometry of the triangle formed by the axis of the pivot, the support elements and the point of contact of the flange on the workpiece determines amplification of forces applied to the workpiece and which are transmitted in the form of torque between the pivot and the support elements.

Such a device is entirely satisfactory, in particular in terms of quick actuation and compactness, when the support point on the workpiece can be near the device. However, in some configurations, it is preferable, or even indispensable, for this support point to be away from the clamping device due to the stresses of the geometry of the workpiece. This is possible by elongation of the flange, but such elongation increases stresses on the pivot and the support elements or limits the clamping force if said stresses cannot increase. Also, this elongation leads to larger bulk in the release position. In fact, the flange has pivoted by around a quarter turn towards upwards and its length is added to that of the body in the direction of the cylinder.

A possible solution for increasing admissible forces is to move the support elements away from the position of the pivot in the gripping position. This in turn increases the length of the body and the height of the flange, which increases the bulk of the device both in gripping position and in release position. This solution therefore is not optimal due to this excessive bulk.

SUMMARY

The aim of the invention is a clamping device of a workpiece for a tool which is compact, rapid and powerful, even if the point clamping must be moved away.

With these aims in focus, the object of the invention is a clamping device of a workpiece on a tool, comprising a cylinder and a flange, the cylinder being selectively actuated by pressurised fluid and in turn comprising a body intended to be fixed to the tool and a slide mounted to slide relative to the body, the flange being hinged about a pivot axis on the slide, the body comprising a front face beyond which the flange projects when it is in a gripping position to clamp the workpiece, the flange also having a release position it reaches at least partially by pivoting about the pivot axis, the device comprising guide members which comprise a fixed guide member relative to the body and a mobile guide member connected to the flange cooperating together to drive the flange in a rotation movement about the pivot axis at least to completion of travel towards the release position and as per translation movement at least to completion of travel towards the gripping position, the device being characterized in that the fixed guide member comprises at least one hollowed groove in the body and the mobile guide member comprises at least one finger engaged in the groove.

Due to the translation movement during the clamping phase, the workpiece is well clamped without sliding movement being triggered. On the contrary, rotation during the release phase rapidly releases the flange to leave access to the workpiece on the tool to unload it and load a fresh one in a direct movement along the front face. This succession of movements is obtained with simple control by a single cylinder. The finger has the form of a nipple or a roller and is fixed on the flange at a distance from the pivot axis. If the groove were arranged on the flange, it would have the disadvantage of weakening the cross-section of the latter. In the invention, the body can be made with a strong cross-section which is not overly affected by the groove.

In particular, the groove extends according to a trajectory whereof a first portion is parallel to the direction of translation of the flange and a second portion is oriented obliquely relative to the first portion, the finger located in the first portion when the flange is in the gripping position or near and in the second portion when the flange is driven to pivot. Pushing on the finger during its displacement in the groove guides the movement of the flange, in particular to control pivoting towards the release position and translation towards the gripping position. When the finger is in the first portion of the groove, the relative position of the pivot axis and of the roller is not modified, and the flange retains the same orientation, which determines translation movement. In contrast, when the roller is in the second portion of the groove, the relative position of the pivot axis and of the finger is modified, and the flange pivots on the pivot axis.

According to a constructive arrangement, the finger is located at a distance from the pivot axis, moved away in the direction of translation of the rod from the gripping position to the release position. It is evident that this arrangement is easier to execute, leaving space between the pivot axis and the cylinder rod without stress to limit the length of the rod.

According to another characteristic, the slide comprises a piston and a rod joined by assembly and the pivot axis is offset by a predetermined distance relative to the axis of the rod in the direction of the front face. Moving the pivot axis in the direction of the workpiece to be clamped first shortens the distance between the pivoting point and the support point on the workpiece. This increases the force which can be applied to the workpiece. Also, the release position of the flange is offset towards the workpiece, which decreases the bulk in the direction opposite the workpiece. Also, the distance between the end of the flange and that of the pivot axis decreases, in turn decreasing the bulk in height of the device in release position, for a determined distance between the body of the device and the support point on the workpiece. The substantial offset of the pivot axis is possible due to the slide being made in two workpieces. In fact, the size of the upper part of the slide is not limited to the passage diameter of the rod in the body, but can be greater.

In particular, the piston and the rod are assembled by screwing into each other.

According to a constructive arrangement, the body comprises a cap for closing a cylinder chamber delimited by the piston and a bore of the body in which the piston slides. The cylinder can be mounted by introducing the piston into the bore, assembling it with the rod, then blocking the bore with the cap to create the cylinder chamber.

According to another characteristic, the clamping device comprises upper support elements, the upper support elements comprising an upper fixed support element fixed relative to the body, and a mobile upper support element connected to the flange, the fixed and mobile upper support elements cooperating, at least to completion of travel of the flange towards the gripping position, to mutually offer sliding contact parallel to the translation movement of the flange and to oppose pivoting of the flange towards the release position. Direct transmission of forces is made between the flange and the body of the flange, ensuring good rigidity and good capacity for collecting the clamping forces.

In addition, the clamping device comprises lower support elements comprising a lower fixed support element, fixed relative to the body, and a lower mobile support element connected to the rod, the fixed and mobile lower support elements cooperating, at least on completion of travel of the flange towards the gripping position, to mutually offer sliding contact parallel to the translation movement of the flange. The lower support elements absorb forces transmitted by the flange during clamping by means of the rod. And preferably, the lower mobile support element is at the level of the pivot axis of the flange such that the forces are transmitted without generating torque on the rod.

According to an improvement, the clamping device comprises a detection conduit terminating on the upper fixed support element and intended to be connected in fluid communication with a device for detecting a fluid leak. When the flange is in gripping position, the upper fixed support element is in contact with the mobile upper support element, blocking the output of the detection conduit. This is a highly compact element for detecting the closing or opening of the flange. The fluid used is typically air. A particular form can also be provided on the mobile support element so that detection is performed only within a very precise range of position.

Another aim of the invention is a mounting method of a clamping device such as described previously, according to which the rod is placed on the body to have it terminate in the body, and the piston is assembled on the terminating part of the rod.

BRIEF DESCRIPTION OF THE DRAWINGS

The invention will be better understood and other particular features and advantages will emerge from the following description, the description making reference to the appended drawings, in which.

DETAILED DESCRIPTION

A clamping device according to a first embodiment of the invention is intended to clamp a workpiece on a tool. The device comprises a body 1 fixed on the tool, for example by means of a collar 10 screwed onto the tool. The body 1 essentially comprises a cylindrical part 11 to one side of the collar 10, and a part in the form of a clevis 12 opposite the cylindrical part 11. Arbitrarily and for clearer description, it is considered that the bottom of the device is the cylindrical part 11 and the top is the clevis 12. However, the device can be mounted on the tool in any orientation.

Figure 1:
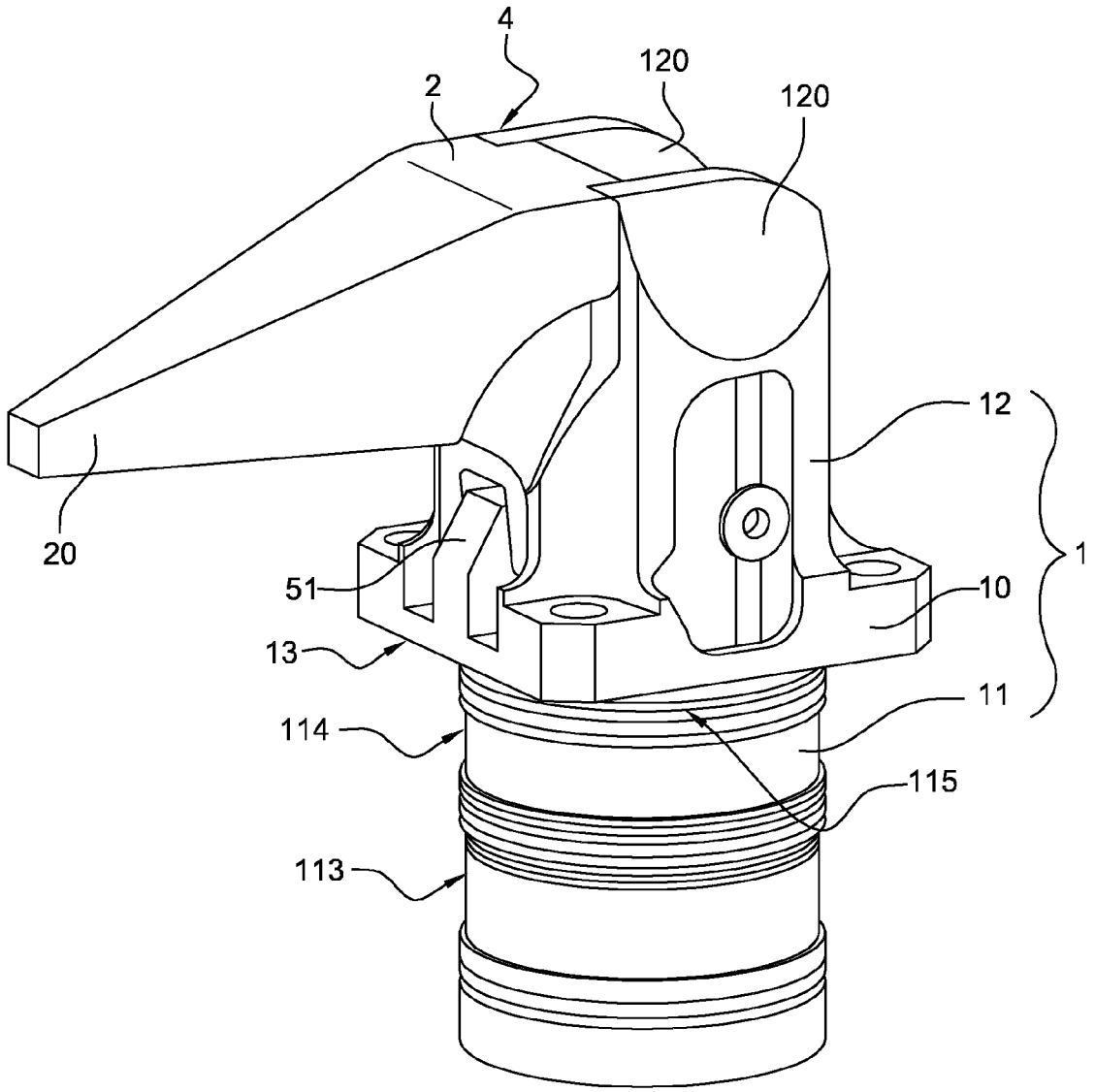
FIG. 1 is a perspective view of the clamping device according to a first embodiment of the invention, in gripping position.
Figure 2:
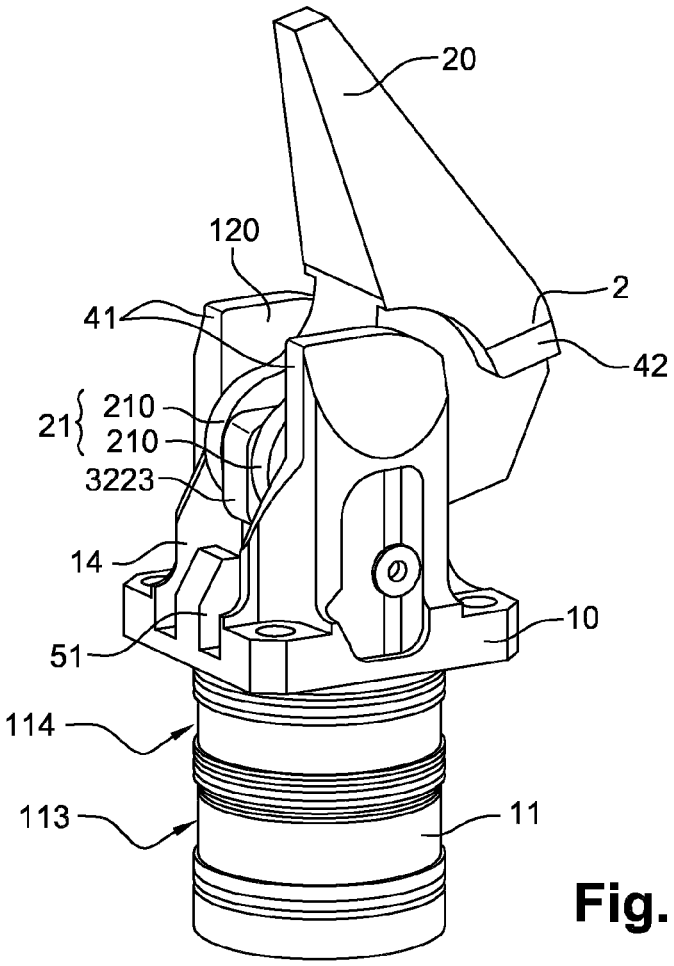
FIG. 2 is a view similar to FIG. 1, in a release position.
Figure 3:
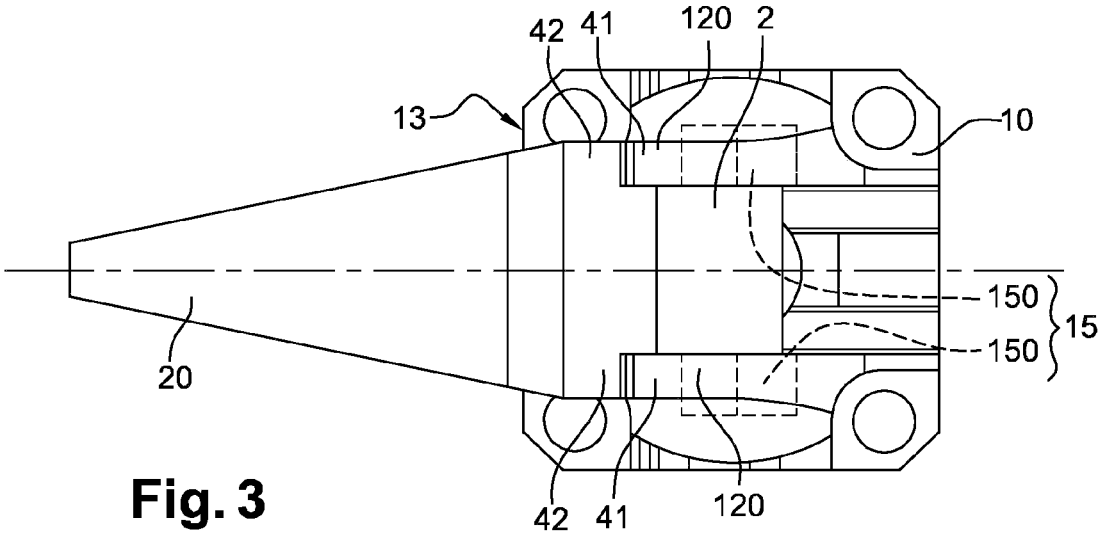
FIG. 3 is a plan view of the device of FIG. 1.
Figure 4:
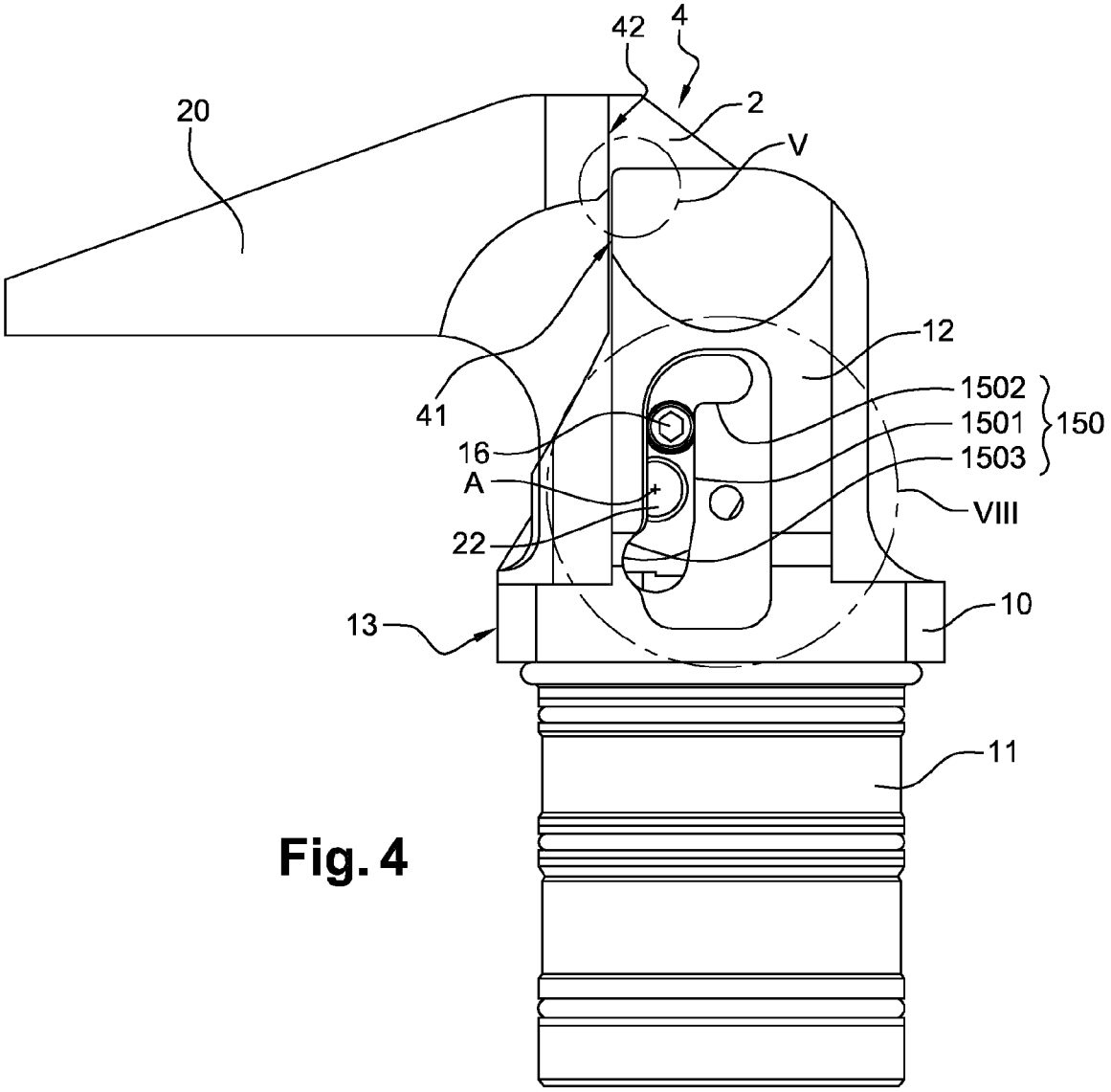
FIG. 4 is a side elevation of the device of FIG. 1, in an intermediate position between the gripping position and the release position.
Figure 6:
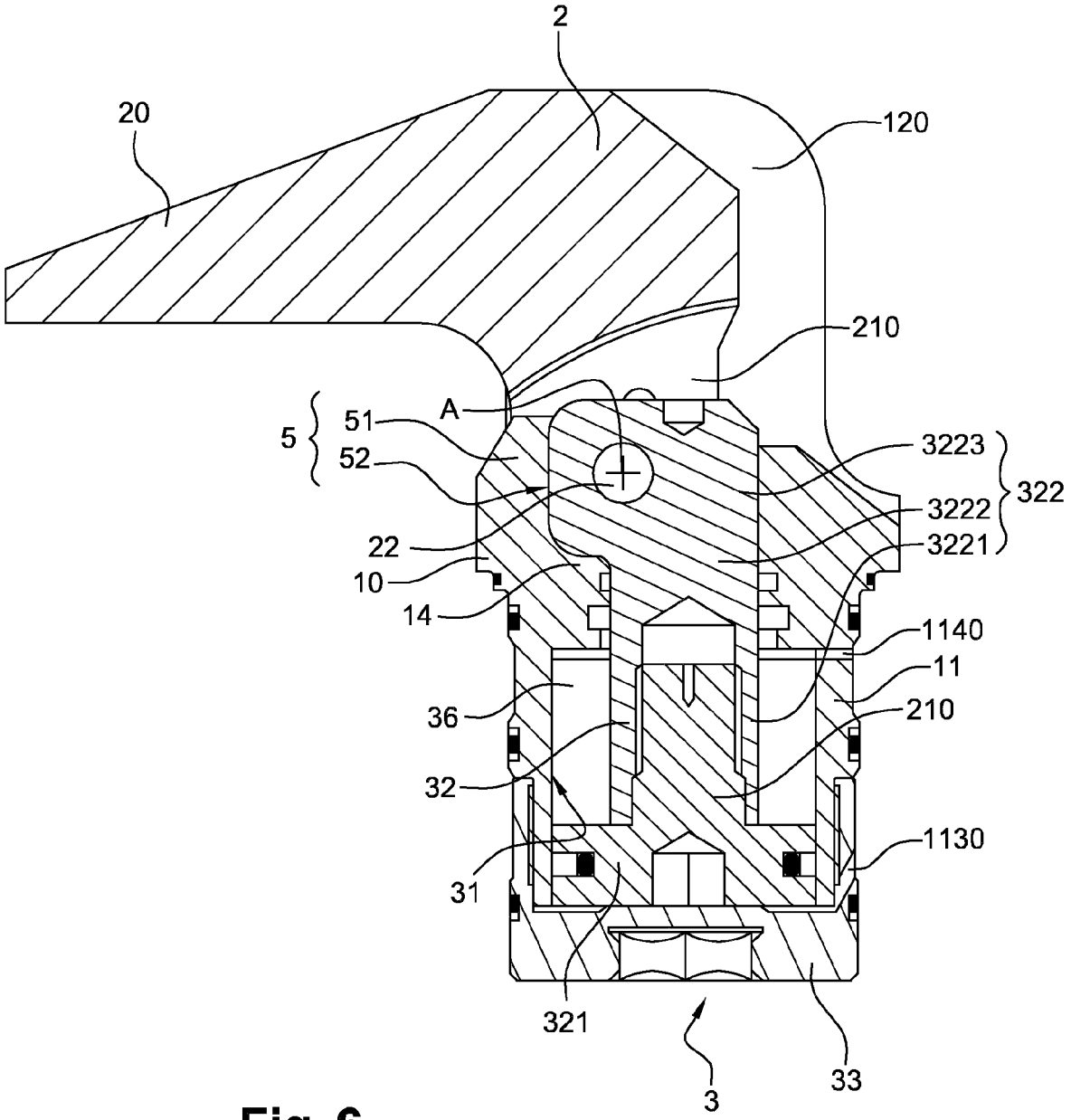
FIG. 6 is a sectional view of the device according to a longitudinal plane in gripping position.
Figure 7:
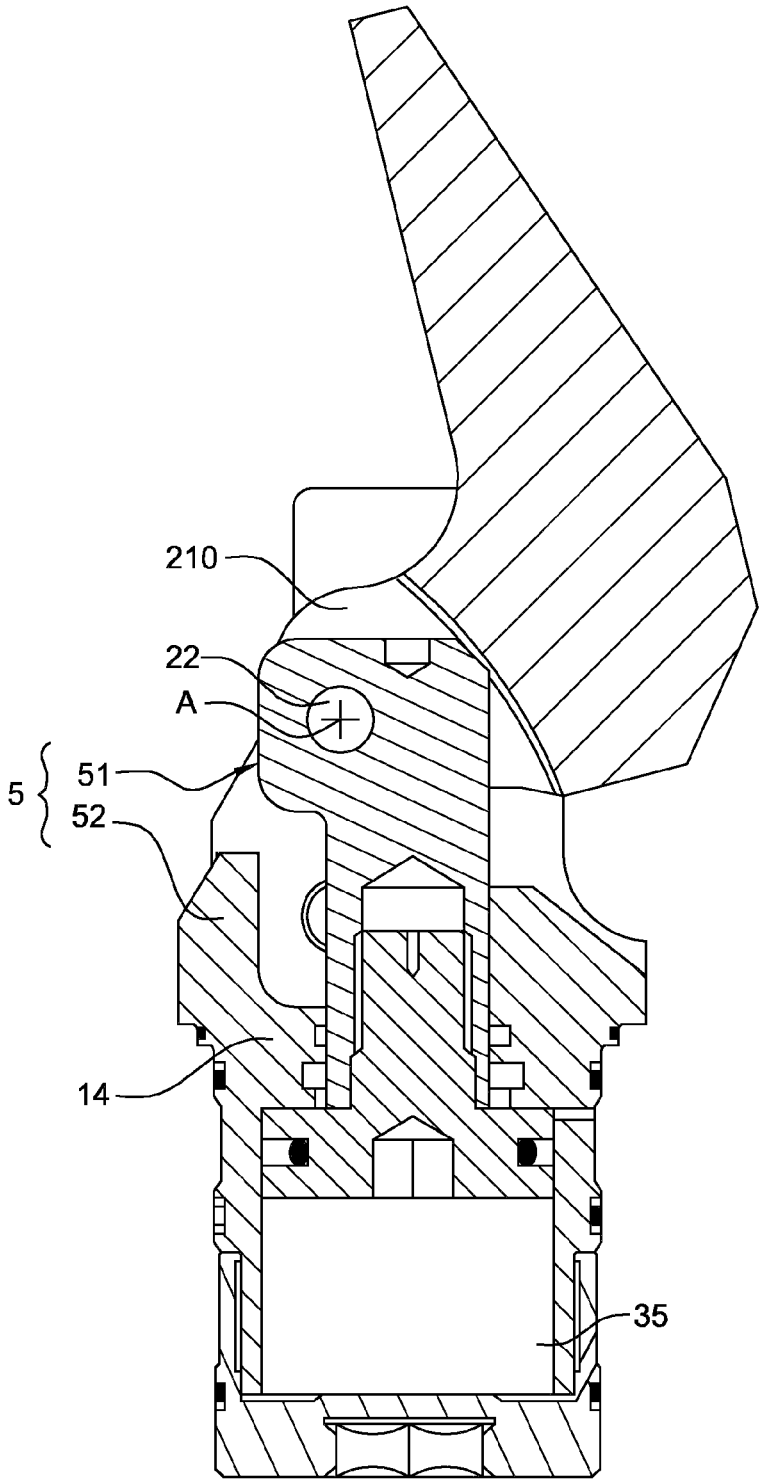
FIG. 7 is a view similar to FIG. 6, in the release position.
Figure 8:
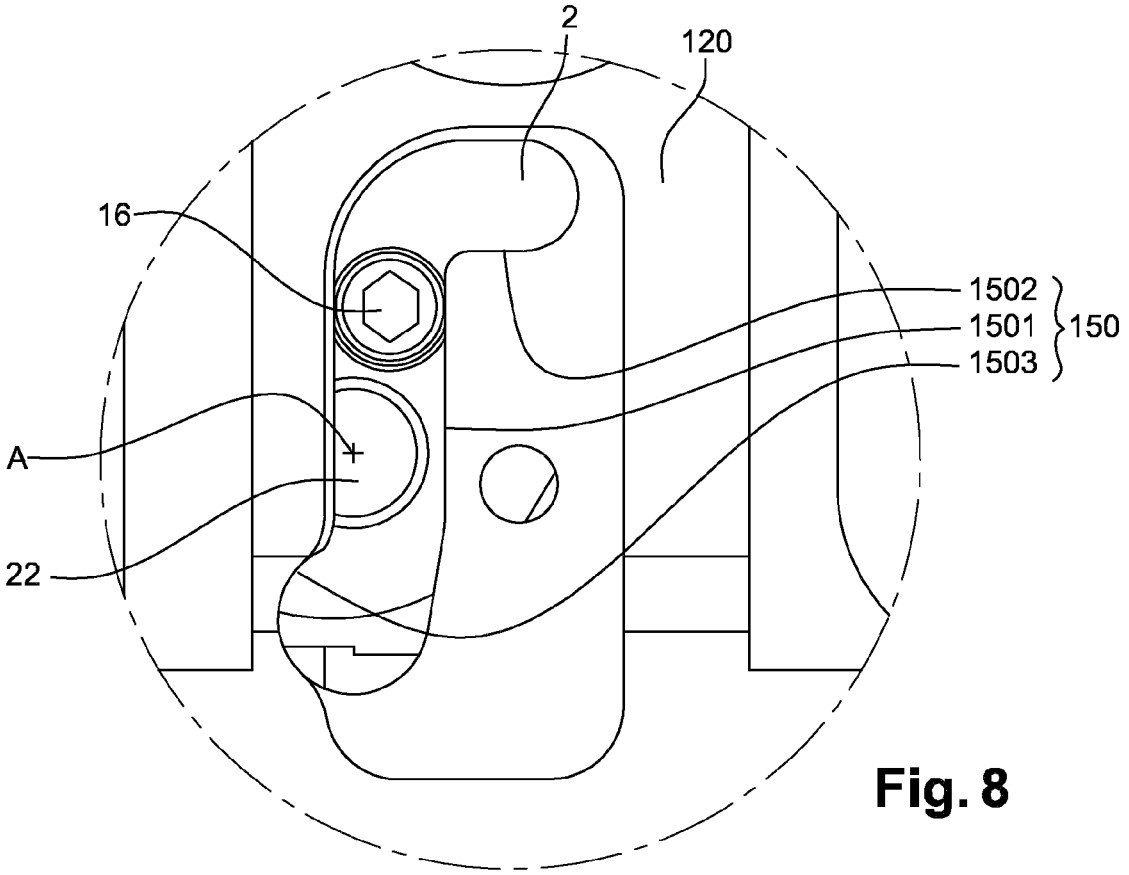
FIG. 8 is a view of the detail VIII of FIG. 4.

The clamping device also comprises a flange 2 mounted mobile between two wings 120 of the clevis 12. The flange 2 comprises an arm 20 at the end of which a support point is intended to clamp the workpiece. The flange 2 has a gripping position in which it projects beyond a front face 13 of the body 1 and in which it is likely to clamp the workpiece on the tool, as shown in FIGS. 1, 4 and 6. It also has a release position in which the front face 13 is totally released upwards and the arm 20 is raised, as shown in particular in FIGS. 2 and 7. The flange 2 projects upwards.

A cylinder 3 is housed in the cylindrical part 11. It comprises a bore 31 made in the body 1 and in which a slide 32 is mounted to slide. A cap 33 blocks the bore 31 by being screwed onto the exterior of the cylindrical part 11 of the body 1. The slide 32 is divided into two parts joined together: a piston 321 and a rod 322. The piston 321 has the form of a disc from which a threaded part projects 3210 placed at the centre of the disc. The rod 322 comprises a threaded muff 3221, followed by a smooth part 3222 then a foot 3223 wider than the smooth part 3222. The smooth part 3222 is adjusted to slide in a neck 14 of the body 1, succeeding the bore 31, whereas the foot 3223 is located beyond the neck 14, in the space between the wings 120 of the clevis 12. The threaded part 3210 is screwed into the muff 3221 of the rod 322. A first chamber 35 is delimited in the bore 31 between the piston 321 and the cap 33 while a second chamber 36 is delimited between said piston 321 and the neck 14. On the outside the cylindrical part 11 comprises two shallow distribution throats 113, 114. Each distribution throat 113, 114 is in communication with one of the chambers 35, 36 of the cylinder 3 by means a respective supply conduit 1130, 1140. Sealing throats are provided on either side of the distribution throats to insulate the latter when the body 1 of the device is placed in a cylindrical housing of the tool, not shown here. Two channels are to be provided terminating in the housing opposite the distribution throats to supply the cylinder 3 with pressurised fluid such as oil or air via the distribution throats 113, 114 and the supply conduits 1130, 1140.

The flange 2 is hinged about a pivot axis A on the foot 3223 of the slide 32. Due to the form of the foot 3223, it is possible to offset the pivot axis A relative to the axis of the slide 32 such that the latter is for example offset in the direction of the front face 13 by a value close to the radius of the smooth part 3222 of the rod 322. The flange 2 reaches the release position by pivoting about the pivot axis A. The movement of the flange 2 also comprises a sliding phase given by the sliding of the piston 321. The flange 2 comprises a flange clevis 21 comprising two wings 210 which enclose the foot 3223. The pivot axis A is made by a trunnion 22 passing through the wings 210 of the flange clevis 21 and the foot 3223.

The device comprises guide members which comprise a fixed guide member 15 relative to the body 1 and a mobile guide member 16 connected to the flange 2 cooperating together to cause pivoting of the flange 2 about the pivot axis A to completion of travel towards the release position. The guide members 15, 16 also impose translation movement to completion of travel towards the gripping position.

The fixed guide member 15 is formed by two grooves 150 made respectively in the wings 120 of the clevis 12 passing through. The groove 150 extends according to a trajectory whereof a first portion 1501 is parallel to the direction of translation of the flange 2 and a second portion 1502 is oriented obliquely relative to the first portion 1501, practically at 90°. The second portion 1502 is oriented towards the rear, opposite the front face 13. The two portions are connected by a curved portion. The groove 150 is extended downwards to create a passage 1503 opposite the pivot axis A when the flange 2 is in gripping position. This passage enables introduction of the trunnion 22 during assembly of the device.

The mobile guide member is a finger 16 in the form of a nipple. In practice, the nipple 16 is screwed onto the flange 2 and comprises a cylindrical head of diameter adjusted to the width of the groove 150. The nipple 16 is placed above the pivot axis A.

The clamping device comprises also upper support elements 4 and lower support elements 5. The upper support elements 4 comprise an upper fixed support element 41, fixed relative to the body 1, and a mobile upper support element 42 connected to the flange 2. The upper fixed support element 41 is formed by two support surfaces substantially vertical in front of the wings 120 of the clevis 12. The mobile upper support element 42 comprises two stubs projecting from the faces of the flange 2 and offering two vertical support surfaces when the flange 2 is in gripping position. In this way, the upper fixed and mobile support elements 41, 42 cooperate to completion of travel of the flange 2 towards the gripping position to mutually offer sliding contact parallel to the translation movement of the flange 2 and oppose pivoting of the flange 2 towards the release position.

The lower support elements 5 comprise a lower fixed support element 51, fixed relative to the body 1, and a lower mobile support element 52 connected to the rod 322. The lower fixed support element 51 has the form of a groove placed along the foot 3223 of the rod 322 between the wings 210 of the flange clevis 21. The lower mobile support element 52 comprises a support surface borne by the foot 3223 opposite the groove 51. The fixed and mobile lower support elements 51, 52 cooperate to completion of travel of the flange 2 towards the gripping position to mutually offer sliding contact parallel to the translation movement of the flange 2. In cooperation with the upper support elements 4, the flange 2 is retained very rigidly when it is placed supported against a workpiece to be clamped, with support planes which opposing the torque generated by contact with the flange 2 on the workpiece in front of the device.

Figure 5:
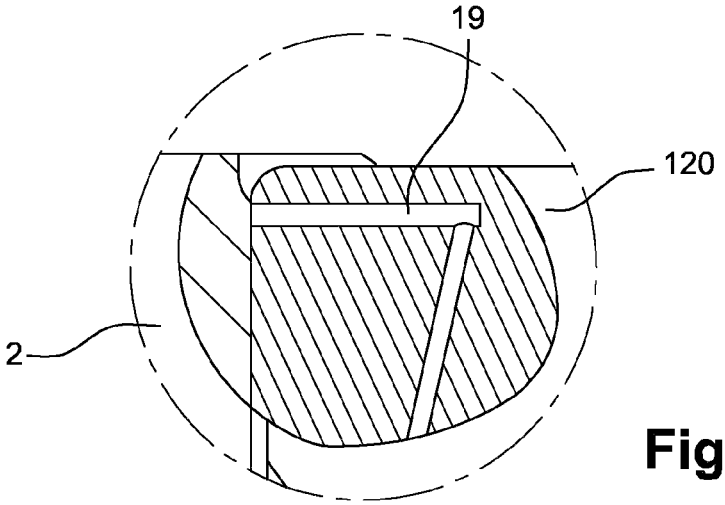
FIG. 5 is a view of the detail V of FIG. 4, the device being in the gripping position.

A detection conduit 19 is provided terminating on the upper fixed support element 41, as shown in FIG. 5, and intended to be connected in fluid communication with a device for detecting a fluid leak. For this, the detection conduit 19 comprises a joining section terminating in a detection throat 115, between the collar 10 and the sealing throat closest to the collar 10. The mobile upper support element comprises an indentation which is opposite the output of the detection conduit 19 when the flange has completed travel towards the gripping position. It could therefore be considered that the flange has not been stopped by the workpiece to be clamped, and therefore the workpiece is absent in this position.

Operation of the Device

It is supposed that the device is initially in the gripping position, as shown in FIG. 1. The piston 321 is towards the bottom such that the first chamber 35 has reduced volume. With the flange 2 placed at the very bottom, the fixed and mobile support elements are in contact with each other. The flange 2 is oriented to project beyond the front face 13.

The flange 2 is actuated by sending pressurised fluid to the first chamber 35. The fluid of the second chamber 36 escapes and lets the piston 321 rise. The flange 2, driven by the foot 3223, also rises with a translation movement, guided also by the finger 16 which circulates in the first portion 1501 of the grooves 150. When the finger 16 arrives at the end of the first portion 1501, the upper support elements 4 are released from each other. The finger releases in the second portion 1502 of the groove 150, causing pivoting of the flange 2 about the pivot axis A on the foot 3223 of the cylinder 3 in the direction of arrow F1. The upper mobile support element passes over the clevis 12. The flange 2 then reaches the release position in which it does not project beyond the front face 13, but in which the arm 20 is placed above the clevis 12 pointing upwards. The space before the device is released to remove a workpiece and put one in place.

To achieve clamping of the workpiece, the cylinder 3 is controlled in the reverse direction, that is, the pressurised fluid is sent to the second chamber 36 and allows it to escape from the first chamber 35. The piston 321 commences displacement downwards. The finger 16 is forced to traverse the groove 150 in the second portion 1502, causing pivoting of the flange 2 in reverse of arrow F1, that is, towards lowering of the arm 20 above the workpiece beyond the front face 13. When the finger reaches the first portion 1501 of the groove 150, the piston 321 continues its sliding course by driving the flange 2 downwards. The upper support elements engage by being opposite. When the arm 20 comes into contact with the workpiece at the level of the support point and exerts clamping force on it, the flange 2 is supported against the clevis 12 at the level of the upper support elements 4. It also tends to press the rod 322 of the cylinder 3 against the groove at the level of the lower support elements 5. The flange 2 is held supported rigidly on the workpiece.

Figure 9:
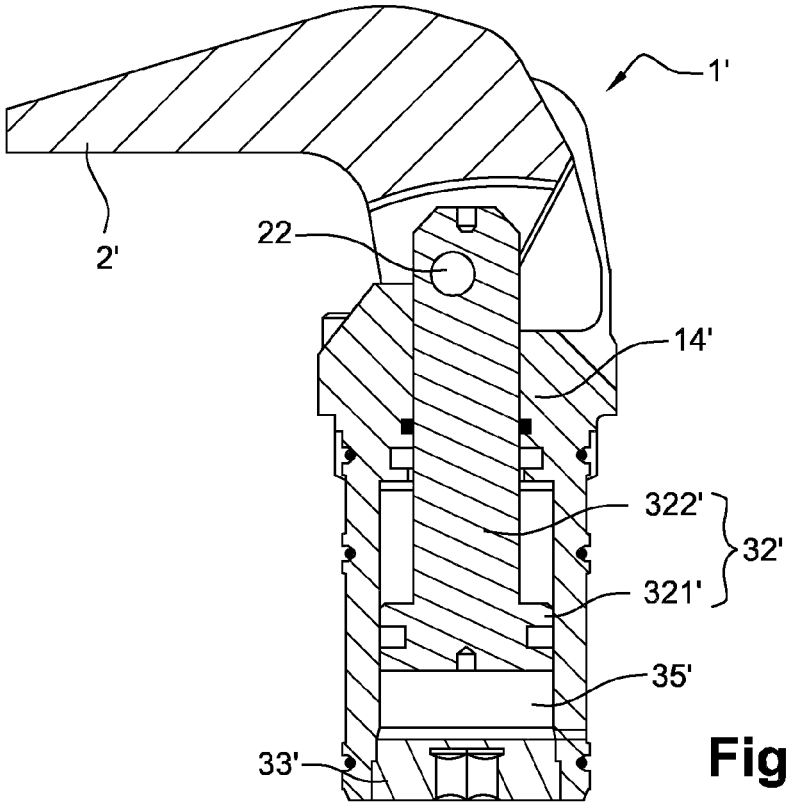
FIG. 9 is a view similar to FIG. 6 of a flange according to a second embodiment of the invention.

According to a second embodiment, shown in FIG. 9, a clamping device is distinguished from the device according to the first embodiment in that the slide 32' is made in a single workpiece comprising the rod 322' and the piston 321'.

To install such a device, the rod 322' of the slide is introduced into the neck 14' by passing it through the chamber of the cylinder. The trunnion 22 id then put in place to assemble the rod 322' with the flange 2'. The cap 33' is screwed onto the body 1' to close the chamber 35' of the cylinder. The operation of the device is the same as for the first embodiment.

The invention is not limited to the embodiments described above.

The invention claimed is:

1. A clamping device for clamping a workpiece on a tool, the device comprising:

a body comprising a front face and a lower portion fixed to the tool when operating;

a cylinder having an axis directed along direction and being disposed within the lower portion;

a slide that is slidably mounted relative to the body and movable along the axis of the cylinder, wherein the slide comprises a piston and a rod joined by assembly;

a flange hinged about a pivot axis on the slide to move from a clamping position to a release position, wherein the pivot axis is offset by a predetermined distance relative to an axis of the rod in a second direction of the front face;

a groove in the body; and a finger extending from and directly attached to the flange and through the groove and cooperating to drive the flange in a rotational movement about the pivot axis at least to completion of travel towards the release position and through a translation movement at least to completion of travel towards the clamping position, wherein translational movement of the finger within the groove causes the flange to pivot about the pivot axis towards the clamping position, the groove enclosing the finger and comprising a first portion and a second portion, the first portion being parallel to the axis of the cylinder and the second portion being substantially perpendicular to the first portion;

wherein when the flange is in the clamping position, (i) the workpiece can be clamped between the flange and the tool and (ii) the flange is substantially perpendicular to and projects beyond the front face, and when the flange is in the release position, the flange points substantially along the direction of the axis of the cylinder.

2. The clamping device according to claim 1, wherein the groove extends according to a trajectory where the first portion is parallel to a direction of translation of the flange and the second portion is oriented obliquely relative to the first portion, the finger being located in the first portion when the flange is in or near the clamping position and in the second portion when the flange is driven to pivot.

3. The clamping device according to claim 1, wherein the finger is located at a distance from the pivot axis, away in a direction of translation of the rod from the clamping position to the release position.

4. The clamping device according to claim 1 wherein the piston and the rod are assembled by screwing into each other.

5. The clamping device according to claim 1, wherein the body comprises a cap for closing a cylinder chamber delimited by the piston and a bore of the body wherein the piston slides.

6. The clamping device according to claim 1, further comprising upper support elements that each comprise a fixed upper support element, fixed relative to the body, and a mobile upper support element connected to the flange, the fixed and mobile upper support elements cooperating, at least to completion of travel of the flange towards the clamping position, to mutually provide sliding contact parallel to the translation movement of the flange and oppose pivoting of the flange towards the release position.

7. The clamping device according to claim 1, further comprising lower support elements that each comprise a lower fixed support element, fixed relative to the body, and a lower mobile support element connected to a rod, the fixed and mobile lower support elements cooperating, at least on completion of travel of the flange towards the clamping position, to mutually provide sliding contact parallel to the translation movement of the flange.

8. The clamping device according to claim 1, further comprising a detection conduit terminating on a fixed upper support element and configured to connect in fluid communication with a device for detecting a fluid leak.

9. A method for mounting a clamping device, wherein the clamping device comprises:

a body comprising a front face and a lower portion fixed to the tool when operating;

a cylinder having an axis directed along a direction and being disposed within the lower portion;

a slide that is slidably mounted relative to the body and movable along the axis of the cylinder, wherein the slide comprises a piston and a rod joined by assembly;

a flange hinged about a pivot axis on the slide to move from a clamping position to a release position, wherein the pivot axis is offset by a predetermined distance relative, to an axis of the rod in a second direction of the front face;

a groove in the body; and a finger extending from and directly attached to the flange and through the groove and cooperating to drive the flange in a rotational movement about the pivot axis at least to completion of travel towards the release position and through a translation movement at least to completion of travel towards the clamping position, wherein translational movement of the finger within the groove causes the flange to pivot about the pivot axis towards the clamping position, the groove enclosing the finger and comprising a first portion and a second portion, the first portion being parallel to the axis of the cylinder and the second portion being substantially perpendicular to the first portion;

wherein when the flange is in the clamping position, (i) the workpiece can be clamped between the flange and the tool and (ii) the flange is substantially perpendicular to and projects beyond the front face, and when the flange is in the release position, the flange points substantially along the direction of the axis of the cylinder;

the method comprising:

placing the rod on the body to have it terminate in the body, and assembling the piston on a terminating part of the rod.

* * * * *